United States Patent [19]

Suzuki et al.

[11] 4,128,997

[45] Dec. 12, 1978

[54] I.C.E. EQUIPPED WITH MEANS FOR MAINTAINING REACTOR TEMPERATURE ABOUT A SINGLE TEMPERATURE

[75] Inventors: Suzuo Suzuki, Yokosuka; Masayasu Nakajima, Yokohoma; Ken-ichi Koizumi, Yokosuka; Yoshio Ookubo, Yokohama, all of Japan

[73] Assignee: Nissan Motor Company, Limited, Japan

[21] Appl. No.: 727,455

[22] Filed: Sep. 28, 1976

[30] Foreign Application Priority Data

Sep. 29, 1975 [JP] Japan ..... 50-117556

[51] Int. Cl.[2] ..... F02B 75/10; F01N 3/10; F01N 7/10

[52] U.S. Cl. ..... 60/274; 60/285; 60/323; 123/124 A; 123/124 B

[58] Field of Search ..... 60/274, 276, 285, 322, 60/323, 277, 284; 123/119 R, 119 EC, 124 A, 124 B

[56] References Cited

U.S. PATENT DOCUMENTS

| | | | |
|---|---|---|---|
| 3,505,028 | 4/1970 | Douthit | 60/282 |
| 3,724,218 | 4/1973 | Cole | 60/323 |
| 3,807,172 | 4/1974 | Masaki | 60/285 |
| 3,818,701 | 6/1974 | Foster et al. | 60/285 |
| 3,820,326 | 6/1974 | Inoue et al. | 60/285 |
| 3,904,374 | 9/1975 | Rosenlund | 60/322 |
| 3,921,612 | 11/1975 | Aono | 123/119 EC |
| 3,927,523 | 12/1975 | Shoyama et al. | 60/285 |
| 3,955,363 | 5/1976 | Manderscheid | 60/285 |
| 3,979,905 | 9/1976 | Masaki et al. | 60/289 |

FOREIGN PATENT DOCUMENTS

| | | | |
|---|---|---|---|
| 1043717 | 11/1958 | Fed. Rep. of Germany | 60/285 |

*Primary Examiner*—Carlton R. Croyle
*Assistant Examiner*—Thomas I. Ross
*Attorney, Agent, or Firm*—Robert E. Burns; Emmanuel J. Lobato; Bruce L. Adams

[57] ABSTRACT

A temperature sensor is disposed at the upstream or middle portion of a reactor for oxidizing the unburned constituents contained in the exhaust gases discharged from the combustion chambers of the engine. The air-fuel ratio of the air-fuel mixture supplied to the combustion chambers is controlled so as to maintain the temperature of the upstream or middle portion of the reactor at the predetermined level in the vicinity of but higher than the temperature corresponding to the critical point where the temperature of the downstream portion of the reactor begins to decrease.

13 Claims, 6 Drawing Figures

I.C.E. EQUIPPED WITH MEANS FOR MAINTAINING REACTOR TEMPERATURE ABOUT A SINGLE TEMPERATURE

BACKGROUND OF THE INVENTION

This invention relates to an internal combustion engine equipped with a reactor for oxidation of the unburned constituents contained in the exhaust gases discharged from the combustion chambers of the engine, and a method of controlling the temperature within the reactor.

In connection with an internal combustion engine equipped with a reactor for thermally oxidizing the unburned constituents such as carbon monoxide and hydrocarbons contained in the exhaust gases discharged from the combustion chambers of the engine, it is known that the temperature in the reactor is maintained relatively high when the concentration of the unburned constituents in the exhaust gases increased, whereas the temperature is maintained relatively low when the concentration of the unburned constituents is decreased. It is also known that this unburned constituents concentration is increased as the air-fuel ratio of the air-fuel mixture supplied to the combustion chambers becomes lower.

Accordingly, the reactor requires to supply the engine with a richer air-fuel mixture having a lower air-fuel ratio. However, usual engine are supplied with an air-fuel mixture having an air-fuel ratio ranging from 12:1 to 13.5:1 in consideration of preventing the increase of the fuel consumption. Even engine operation on the air-fuel mixture having such a range of air-fuel ratio raises the temperature of the reactor as high as about 840° to 980° C. Additionally, even in the case in which the reactor temperature control is carried out, the reactor temperature is within the above-mentioned high temperature range.

However, experiments reveal that the unburned constituents in the exhaust gases can be sufficiently reacted or oxidized within the reactor even at a temperature lower than the above-mentioned high temperature range. In view of this fact, it is desirable to maintain the reactor temperature as low as possible within a temperature range in which sufficient oxidation reaction of the unburned constituents in the exhaust gases is accomplished.

SUMMARY OF THE INVENTION

It is, therefore, an object of the present invention to provide a new method of controlling the temperature in a reactor for thermally oxidizing the unburned constituents contained in the exhaust gases discharged from the combustion chambers of an internal combustion engine, by which the reactor temperature is maintained as low as possible within the range in which the unburned constituents are sufficiently reacted or oxidized, improving the durability of the reactor.

Another object of the present invention is to provide an internal combustion engine equipped with a reactor for oxidizing the unburned constituents in the exhaust gases discharged from the combustion chambers of the engine, capable of considerably lowering the working temperature of the reactor to improve the durability of the reactor.

A further object of the present invention is to provide an internal combustion engine equipped with a reactor for oxidizing the unburned constituents contained in the exhaust gases discharged from the combustion chambers of the engine, in which control of working temperature of the reactor is accomplished by controlling the air-fuel ratio of the air-fuel mixture supplied to the combustion chambers in response to the temperature at the upstream or middle portion of the reactor.

BRIEF DESCRIPTION OF THE DRAWINGS

Other objects, features and advantages of the present invention will become more apparent from the following description with reference to the accompanying drawing in which like reference numerals indicate like parts and elements, in which.

DESCRIPTION OF THE PREFERRED EMBODIMENTS

Figure 1:
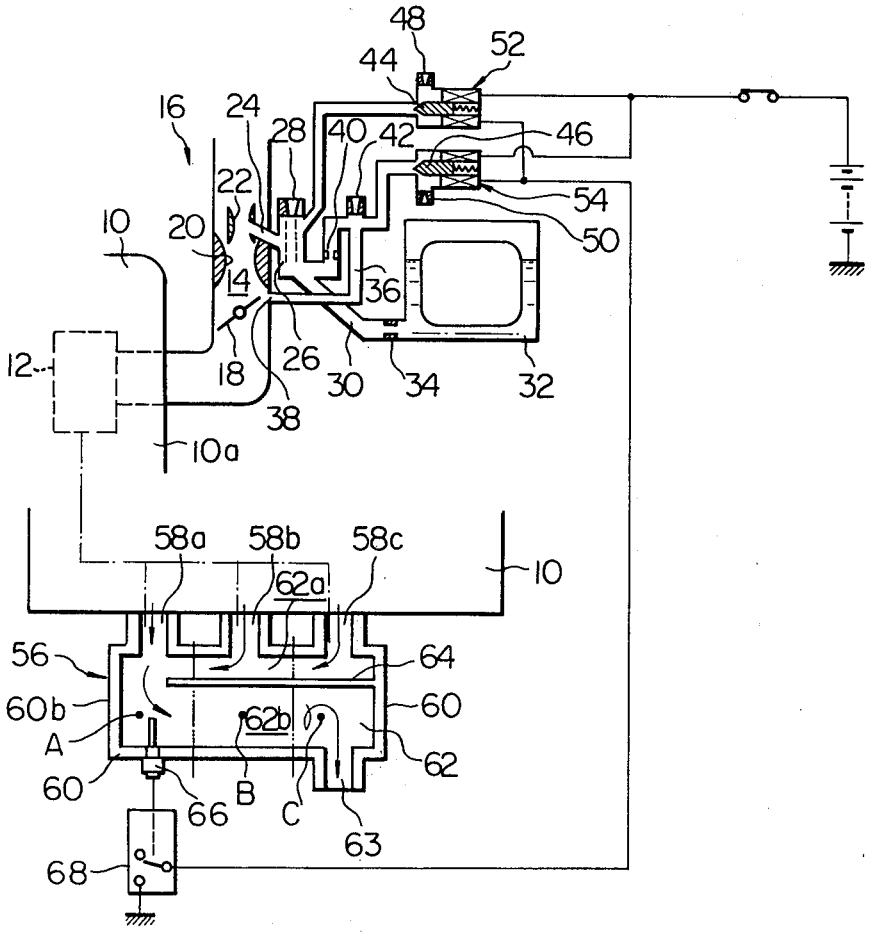
FIG. 1 is a schematical section view of a preferred embodiment of an internal combustion engine having a reactor, in accordance with the present invention.

Referring now to FIG. 1 of the drawings, a preferred embodiment of an internal combustion engine in accordance with the present invention is composed of an engine propoer 10 having therein a combustion chamber or chambers 12 (only location shown) formed in a cylinder block 10*a* of the engine. The combustion chamber 12 is communicates with an air-fuel mixture induction passage 14 of a carburetor 16 forming part of air-fuel mixture supply means (no numeral). The carburetor 16 has, as usual, a throttle valve 18 disposed rotatably within the air-fuel mixture induction passage 14. A main venturi portion 20 is formed upstream of the throttle valve 18 and a secondary venturi portion 22 is disposed upstream of the main venturi portion 20. Opened to the secondary venturi portion 22 is a main discharge nozzle 24 which is connected to a main well 26 having a main air bleed 28 for bleeding atmospheric air into the main well 26, when opened. The main well 26 communicates through a main fuel passage 30 with a float bowl 32. A main jet 34 is disposed within the main fuel passage 30. A low-speed circuit fuel passage 36 communicates between the main fuel passage 30 and a slow port 38 opening to the air-fuel mixture induction passage 14 downstream of the main venturi portion 20. The low-speed circuit fuel passage 36 is equipped with a restrictor 40 and with a low-speed circuit air bleed 42 for bleeding atmospheric air into the slow-speed circuit fuel passage 36, when opened. Reference numerals 44 and 46 respectively indicate a first auxiliary air bleed communicated with the main well 26 and a second auxiliary air bleed communicated with the low-speed circuit fuel passage 36. The first and second auxiliary air bleeds 44 and 46 communicate through first and second orifices 48 and 50 with the atmosphere, respectively. Electromagnetic valves 52 and 54 are respectively disposed at the first and second auxiliary air bleeds 44 and 46 to open or close them. As shown, the electromagnetic valves 52 and 54 electrically connect in parallel to each other.

The reference numeral 56 indicates a reactor for thermally oxidizing the unburned constituents contained in the exhaust gases discharged from the combustion chamber 12, and therefore the inlets 58*a*, 58*b* and 58*c* of the reactor 56 connect to the one side of the engine proper 10 to communicate through the exhaust ports (not shown) formed in the engine proper 10 with the combustion chambers 12. The reactor 56 is installed to the engine proper 10 such that the longitudinal axis (not identified) of the casing 60 thereof is substantially in parallel to the longitudinal axis (not identified) of the engine proper 10 or of the cylinder block 10*a*. The casing 60 defines thereinside a reaction chamber 62 which has, as indicated, an upstream portion A, middle portion B and a downstream portion C where an outlet 63 is disposed to discharge the exhaust gases into the atmosphere through an exhaust pipe (not shown). The reaction chamber 62 is divided into a first chamber 62*a* and a second chamber 62*b* by a partition wall 64 or means for causing the exhaust gases introduced through the inlets 58*a*, 58*b* and 58*c* to flow from the upstream portion A through the middle portion B to the downstream portion C. As shown, the partition wall 64 is secured to the inner surface of the first closed end 60*a* of the casing 60 and spaced apart from the inner surface of the second closed end 60*b* to communicate the first chamber 62*a* with the second chamber 62*b*. Accordingly, the first chamber 62*a* may form part of the upstream portion A of the reaction chamber 62.

A temperature sensor 66 forming part of temperature sensing means (no numeral) is disposed at a location residing in the first portion A of the reaction chamber 62 and is arranged to generate an electrical signal in response to the temperature in the upstream portion A. The temperature sensor 66 is electrically connected to a switch means 68 which is, in turn, electrically connected to the first and second electromagnetic valves 52 and 54 and is arranged to cause the first and second electromagnetic valves 52 and 54 to respectively open the first and second auxiliary air bleeds 44 and 46 when receiving from the temperature sensor 66 the electric signal representing the temperature over a predetermined level, whereas to cause the first and second electromagnetic valves 52 and 54 to close the first and second auxiliary air bleeds 44 and 46 when receiving from the temperature sensor 66 the electric signal representing the temperature below the predetermined level.

The carburetor 16 is arranged to supply the combustion chamber 12 with a first air-fuel mixture having a first air-fuel ratio causing the temperature of the exhaust gases in the reaction chamber 62 of the reactor 56 to rise to a first temperature range where the unburned constituents in the exhaust gases are effectively thermally oxidized when the first and second auxiliary air bleeds 44 and 46 are closed, and a second air-fuel mixture having a second air-fuel ratio causing the temperature of the exhaust gases in the reaction chamber 62 to fall to a second temperature range where the unburned constituents in the exhaust gases are not oxidized when the first and second auxiliary air bleeds 44 and 46 are opened. It is to be noted that the predetermined level of the temperature is obtained when the temperature in the downstream portion C of the reactor 56 is within the first temperature range.

The arrangement hereinbefore described is contrived on the facts set forth below.

Figure 2:
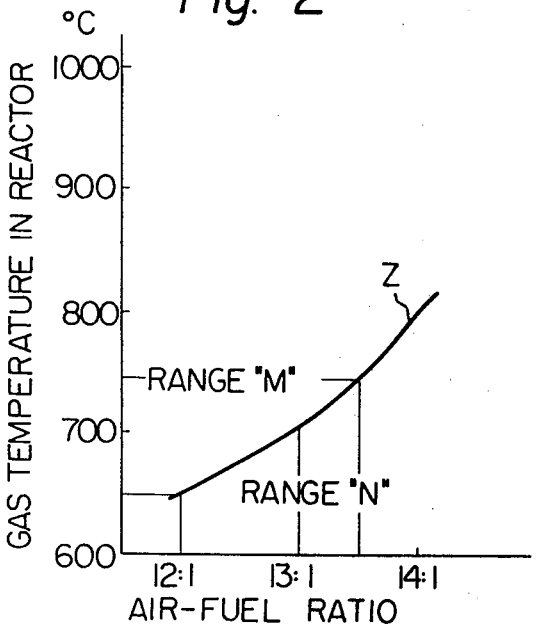
FIG. 2 is a graph showing a lower reaction-temperature limit of a usual reactor in terms of exhaust gas temperature within the reactor and the air-fuel ratio of the air-fuel mixture supplied to the combustion chamber of a usual engine.

As shown in FIG. 2, in general, the unburned constituents contained in the exhaust gases discharged from the combustion chambers 12 of the engine 10 are reacted or oxidized in the reaction chamber 62 of the reactor 56 when the temperature or the temperature of gases in the reaction chamber 62 is above the level of 650° to 750° C. during engine operation on an air-fuel mixture having an air-fuel ratio ranging from 12:1 to 13.5:1. This air-fuel ratio range is slightly richer than stoichiometric and is normally employed at usual engine operation. Of course, the temperature in the reaction chamber 62 of the reactor 56 is varied in accordance with the variation of the air-fuel ratio of the mixture supplied into the combustion chambers 12 of the engine 10. In FIG. 1, A range M indicates the range in which the unburned constituents in the exhaust gases are reacted or oxidized, and a line Z indicates a lower reaction-temperature limit below which the oxidation reaction of the unburned constituents in the exhaust gases is stopped. Accordingly a range N indicates the range in which the unburned constituents in the exhaust gases are not oxidized. It will be appreciated from the foregoing with reference to FIG. 2 that the temperature for the oxidation reaction of the unburned constituents becomes higher as the air-fuel ratio of the air-fuel mixture supplied to the combustion chamber 12 is turned higher, i.e., the air-fuel mixture is lean out.

Figure 3:
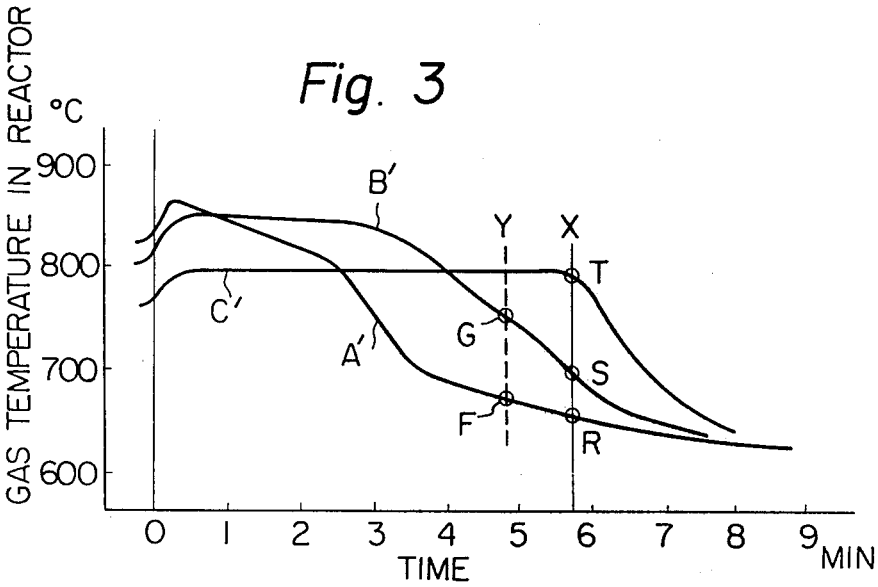
FIG. 3 is a graph showing temperature variations of the exhaust gases passing through the reactor of FIG. 1, in term of time passage after stop of the oxidation reaction in the reactor.

Now, when the condition in the reaction chamber 62 of the reactor 56 is suddenly turned or switched from the range M into the range N lower than the lower reaction-temperature limit Z in FIG. 2 by controlling the air-fuel ratio of the air-fuel mixture supplied to the combustion chamber 12 and/or the spark-ignition timing of the engine 10, the temperature of the upstream, middle and downstream portions A, B and C of the reaction chamber 62 of the reactor 56 are changed and lowered as indicated respectively at lines A', B' and C' in FIG. 3 which generally shows that a high temperature sufficient for oxidation of the unburned constituents is maintained for a while after the condition change or switching to carry out the oxidation reaction within the reaction chamber 62.

As seen in FIG. 3, the temperatures of the upstream and middle portions A and B of the reaction chamber 62 once increase and thereafter decrease, whereas the temperature of the downstream portion C is maintained at a substantially constant high level for an appreciably long period of time and thereafter decreases. This reveals the tendency that the temperature-lowering of the downstream portion C of the reaction chamber 62 is later than of the upstream and middle portions A and B.

Figure 4:
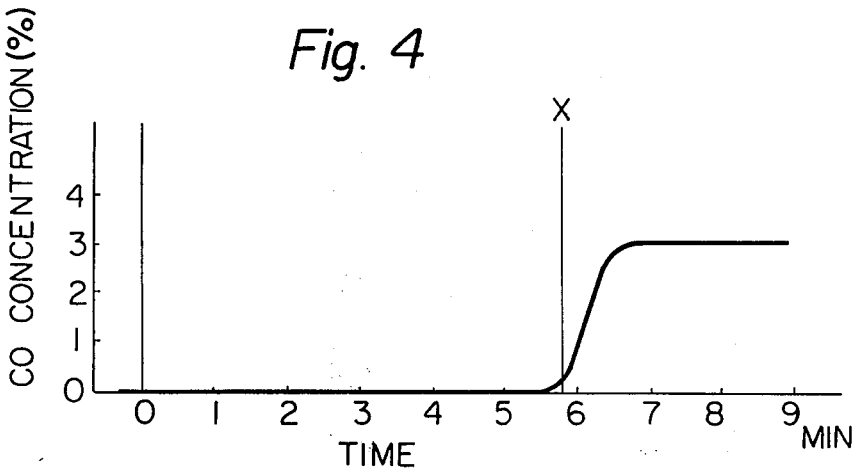
FIG. 4 is a graph showing carbon monoxide concentration of the exhaust gases at the outlet of the reactor of FIG. 1, in term of time passage after stopping of the oxidation reaction in the reactor.

FIG. 4 shows carbon monoxide concentration (%) in the exhaust gases, measured at the outlet 63 of the reactor 56. This figure indicates that the oxidation reaction of the unburned constituents in the exhaust gases is stopped in accordance with the lowering of the temperature of the downstream portion C of the reaction chamber 62, and thereafter the oxidation reaction is not again generated. Accordingly, by maintaining a temperature T shown in FIG. 3 which temperature is at a time passage X in FIG. 4, in other words, by maintaining the high temperature sufficient for the oxidation reaction at the downstream portion C, the total temperature within the reaction chamber 62 can be lowered, because when the temperature of the downstream portion C is at the temperature T, the temperatures of the upstream and middle portions A and B are already lowered respectively to levels R and S shown in FIG. 3 which levels are lower than the temperature T.

As is appreciated from the FIG. 3, it is difficult to maintain the temperature T by sensing the temperature of the downstream portion C of the reaction chamber 62, since the temperature of the downstream portion C rapidly drops from the temperature T at the time passage X and therefore there is not a sufficient time for recovery of the oxidation reaction carried out in the reaction chamber 62. On the contrary, the temperature variations A' and B' of the upstream and middle portions A and B have appreciable slopes crossing through the time passage X and therefore it will be understood that the critical point at which the oxidation in the reaction chamber ceases can be supposed by sensing the temperature R of the upstream portion A or S of the middle portion. Further this critical point can be foreseen by sensing the temperature F of the upstream portion A or G of the middle portion B at the time passage Y slightly before the time X. Consequently, the temperature T at the downstream portion C can be maintained by controlling the air-fuel ratio of the air-fuel mixture supplied to the combustion chamber 12 so as to maintain the temperatures F or G of the upstream or middle portions A or B of the reaction chamber 62. The control of the air-fuel ratio is, for example, such accomplished as to be changed lower to a value within the range M in FIG. 2, when the temperatures of the upstream and middle portions A or B of the reaction chamber 62 fall respectively below the temperatures F or G, whereas be changed higher to a value within the range N in FIG. 2 when the temperatures of the upstream portion A or the middle portion B of the reaction chamber 62 exceed respectively the temperatures F or G. Since the temperature F or G is determined in the vicinity but higher than the critical point R or S, there is a sufficient time for recovery of the temperature decrease from the F or G, and the temperature is prevented from decreasing across the critical point (the temperature R or S).

Experiments have revealed that the maximum temperature in the reaction chamber 62 of the reactor 56 was within the range from 770° to 780° C. when the air-fuel ratio of the air-fuel mixture supplied to the combustion chamber 12 of the engine 10 was controlled to attain a satisfactory CO emission decrease level, setting the above-mentioned temperature F of the combustion chamber upstream portion A at a temperature of 650° C. On the contrary, the maximum temperature in the reaction chamber 62 was over a temperature of 840° C. when the same satisfactory CO emission decrease level is attained without control of the air-fuel ratio of the air-fuel mixture supplied to the combustion chamber 12 of the engine 10. This shows that the working temperature of the reactor 56 is remarkedly lowered by controlling the air-fuel ratio in accordance with the temperature F of the upstream portion A of the combustion chamber 62 of the reactor 56.

The operation of the engine according to the present invention will be explained particularly with reference to FIG. 1.

When the temperature sensor 66 generates the electrical signal representing the temperature below the predetermined level or the temperature F and transmits it to the switch means 68, the switch means 68 causes the first and second electromagnetic valves 52 and 54 to close the first and second auxiliary air bleeds 44 and 46, respectively. Then, supply of the atmospheric air into the main well 26 and the low-speed circuit fuel passage 36 through the first and second auxiliary air bleeds 44 and 46 is stopped and therefore the air-fuel mixture supplied to the combustion chambers 12 through the air-fuel mixture induction passage 14 of the carburetor 16 is enriched into the first air-fuel mixture having the first air-fuel ratio. Consequently, the exhaust gases introduced from the combustion chambers 12 into the reaction chamber 62 of the reactor 56 raises the temperature of the upstream and middle portions A and B to maintain the temperature of the portion C within the first temperature range or the range M thereby effectively thermally oxidizing the unburned constituents contained in the exhaust gases.

On the contrary, when the temperature sensor 66 generates the electrical signal representing the temperature higher than the predetermined level or the temperature F and transmits it to the switch means 68, the switch means 68 causes the first and second electromagnetic valves 52 and 54 to open the first and second auxiliary air bleeds 44 and 46, respectively. Accordingly, the main well 26 and the low-speed circuit fuel passage 36 are fed with atmospheric air respectively through the first and second auxiliary air bleeds 44 and 46 and therefore the air-fuel mixture supplied to the combustion chambers 12 through the air-fuel mixture induction passage 14 of the carburetor 16 is leaned out to the second air-fuel mixture having the second air-fuel ratio which causes the temperature of the exhaust gas to fall into the second range or the range N. As a result, the exhaust gases introduced from the combustion chambers 12 into the reaction chamber 62 of the reactor 56 lowers the temperature of the upstream and middle portions A, B of the reaction chamber.

While the embodiment in FIG. 1 has shown and described an instance where the temperature sensor 66 is disposed at the upstream portion A of the reaction chamber 62 of the reactor 56, it will be understood that the sensor 66 may be disposed at the middle portion B of the reaction chamber 62, setting the predetermined level or temperature at the temperature G in FIG. 3.

Figure 5:
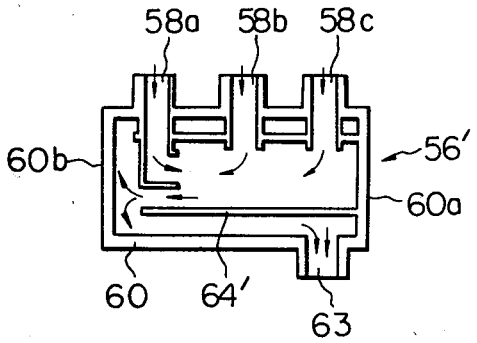
FIG. 5 is a schematical section view of a reactor similar to that of FIG. 1, but showing another example of the reactor.

FIG. 5 shows another example of the reactor 56' which allows the directional guidance of the gases passing through reaction chamber 62 formed within the reactor 56'. As seen, the reactor 56' comprises a cylindrical elongate casing 60 within which a cylindrical core 64' defining thereinside a bore (no numeral) is disposed coaxially spacing apart from the inner surface of the cylindrical portion of the casing 60. The cylindrical core 64' is secured at its one end to the inner surface of the first closed end **60*a* of the casing 60 and spaced apart at its other end from the inner surface of the second closed end 60*b* of the casing 60 to communicate between the inside and the outside of the core 64'. The inlets 58*a*, 58*b* and 58*c* of the reactor 56' open to the inside of the core 64' through the wall of the casing 60 to introduce the exhaust gases from the combustion chambers 12 into the core 64'. The outlet 63 is located at the cylindrical portion of the casing 60 adjacent to the first closed end 60*a*. It will be appreciated that the exhaust gases introduced through the inlets 58*a* to 58*c* inside of the core 64' can be guided in one direction from the upstream to downstream portions of the reaction chamber 62 formed inside of the casing 60**.

Figure 6:
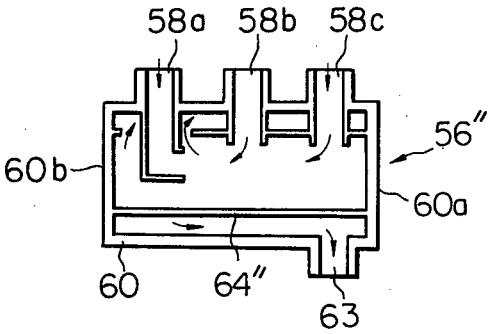
FIG. 6 is a schematical section view of a reactor similar to that of FIG. 1, but showing a further example of the reactor.

FIG. 6 shows a further example of the reactor 56'' which comprises the cylindrical elongate casing 60. Disposed coaxially within the casing 60 is a cylindrical core 64'' spaced apart from the inner surface of the cylindrical portion of the casing 60. The core 64'' is secured at its both ends to the inner surfaces of the first and second closed ends **60*a* and 60*b* of the casing 60. The core 64'' has an opening (no numeral) formed through its wall adjacent to the second closed end 60*b* to communicate between the inside and the outside of the core 64''. The inlets 58*a* to 58*c* are open to the inside of the core 64'' through the casing wall to introduce the exhaust gases from the combustion chambers 12 into the inside of the core 64''. The outlet 63 is located at the cylindrical portion of the casing adjacent to the first closed end 60*a* of the casing 60. It will be understood also in this instance that the exhaust gases introduced inside of the core 64'' can be guided in one direction from the upstream to downstream portions of the reaction chamber 62 formed inside of the casing 60**.

While the air-fuel ratio of the air-fuel mixture has been arranged to be changed only by controlling atmospheric air inducted into the main well 26 and the low-speed circuit fuel passage 36 in the instance of FIG. 1, the air-fuel ratio change may also be accomplished by controlling the amount of the fuel passing through the main fuel passage 30 and the low-speed circuit fuel passage 36, or by directly controlling the amount of air inducted through the air-fuel mixture induction passage 14 of the carburetor 16. In case of the engine employing an electronically controlled fuel injection system in the air-fuel mixture supply means, the air-fuel ratio change may be achieved by controlling an electrical device for changing the fuel amount injected from injectors.

With respect to secondary air fed into the reactor 56 in order to promote the oxidation reaction of the unburned constituents, it may be always fed into the reactor 56 during engine operation, in which the amount of secondary air is increased when the air-fuel mixture supplied into the combustion chambers is enriched into the first air-fuel mixture. Additionally, in order to prevent excessive cooling of the exhaust gases passing through the reactor 56, the supply of the secondary air to the reactor 56 may be stopped when the air-fuel mixture supplied to the combustion chamber is lean out from the first air-fuel mixture into the second air-fuel mixture by which the oxidation reaction in the reactor is stopped. This may be achieved by opening or closing a secondary air supply conduit (not shown) connecting between a secondary air source (not shown) and the reactor 56, in response to the actuation of the switch means 68. It will be understood that the air-fuel ratio change may be accomplished by using one of the above-described measures or combination of several of the measures.

As is apparent from the foregoing discussion, according to the present invention, the reaction temperature of the reactor is maintained considerably lower than usual and therefore durability of the reactor is noticeably improved. Furthermore, the reaction temperature within the reactor is not maintained excessively high to cut the excessive fuel required for excessively heating the reactor, improving fuel consumption of the engine. This makes possible to construct the reactor using inexpensive materials having a relatively low heat resistance.

What is claimed is:

1. A method of controlling the temperature in a reactor for oxidizing the unburned constituents contained in the exhaust gases discharged from an internal combustion engine, said reactor defining therein a reactor chamber including a first portion to which the exhaust gases from the engine are introduced, a second portion downstream of the first portion, and a third portion downstream of the second portion, through which third portion oxidized exhaust gases are discharged out of the reactor, said method comprising the steps of:

sensing a temperature at a location including the first and second portions of the reactor, comparing the sensed temperature with a predetermined temperature which predetermined temperature is obtained when the temperature in the third portion of the reactor is within a first temperature range where the unburned constituents contained in the exhaust gases introduced from the combustion chamber of the engine are effectively thermally oxidized, said predetermined temperature being in close proximity to and higher than a temperature at said location which temperature is obtained immediately before the temperature in the third portion falls below the first temperature range;

supplying the combustion chamber of the engine with a first air-fuel mixture having a first air-fuel ratio which causes the temperature of the exhaust gases throughout the reactor to rise into the first temperature range, when the temperature of said location is below said predetermined temperature; and supplying the combustion chamber of the engine with a second air-fuel mixture having a second air-fuel ratio which causes the temperature of the exhaust gases throughout the reactor to fall into a second temperature range where the unburned constituents contained in the exhaust gases are not oxidized, when the temperature of said location exceeds said predetermined temperature.

2. A method as claimed in claim 1, in which said predetermined temperature is below the temperature in the third portion which temperature is within said first temperature range.

3. An internal combustion engine comprising:

means defining a combustion chamber;

air-fuel mixture supply means for supplying the combustion chamber with an air-fuel mixture;

a reactor disposed downstream of the combustion chamber for thermally oxidizing the unburned constituents contained in the exhaust gases discharged from the combustion chamber, said reactor including an elongate casing defining therein a reaction chamber, said reaction chamber including a first portion communicating with the combustion chamber, a second portion downstream of the first portion, and a third portion downstream of the second portion and communicating with the atmosphere to discharge oxidized exhaust gases out of the reactor;

temperature sensing means for sensing the temperature at a location including said first and second portions of the reaction chamber of said reactor;

means for causing said air-fuel supply means to supply a first air-fuel mixture having a first air-fuel ratio which causes the temperature of the exhaust gases throughout the reactor to rise into a first temperature range where the unburned constituents in the exhaust gases are thermally oxidized, when said temperature sensing means senses a temperature below a predetermined level, and to supply the air-fuel mixture having the second air-fuel ratio which causes the temperature of the exhaust gases throughout the reactor to fall into the second temperature range where the unburned constituents in the exhaust gases are not oxidized, when said temperature sensing means senses a temperature over the predetermined level, said predetermined level being obtained when the temperature in said third portion of said reactor is within the first temperature range, said predetermined level being in close proximity to and higher than a temperature at said location which temperature is obtained immediately before the temperature in the third portion falls below the first temperature range.

4. An internal combustion engine as claimed in claim 3, in which said predetermined temperature is below the temperature in the third portion which temperature is within said first temperature range.

5. An internal combustion engine as claimed in claim 3, in which air-fuel mixture supply means includes a carburetor comprising a throttle valve rotatably disposed within an air-fuel mixture induction passage thereof communicating with the combustion chamber, a venturi portion disposed upstream of said throttle valve, a main discharge nozzle opening to said venturi portion, a main well communicating through a main fuel passage with a float bowl of said carburetor and having a main air bleed for bleeding atmospheric air into said main well, said main discharge nozzle being connected to said main well, a low-speed circuit fuel passage communicating said main fuel passage with a slow port opening to the air-fuel mixture induction passage downstream of said venturi portion, said low-speed circuit fuel passage having a low-speed circuit air bleed for bleeding atmospheric air into said low-speed circuit fuel passage.

6. An internal combustion engine as claimed in claim 5, in which; said means for causing said air-fuel mixture supply and means includes a first auxiliary air bleed communicating with said main well for bleeding atmospheric air into said main well when opened, a secondary auxiliary air bleed communicating with said low-speed circuit fuel passage for bleeding atmospheric air into said low-speed circuit fuel passage when opened, a first electromagnetic valve disposed at said first auxiliary air bleed to open or close said first auxiliary air bleed and, a second electromagnetic valve disposed at said second auxiliary air bleed to open or close said auxiliary air bleed, said air-fuel mixture supply means supplying the first air-fuel mixture when said first and second auxiliary air bleeds are closed, whereas the second air fuel mixture when said first and second auxiliary air bleeds are opened.

7. An internal combustion engine as claimed in claim 6, in which said temperature sensing means includes a temperature sensor disposed at said location and arranged to generate an electric signal in response to the temperature in said location, and switch means electrically connected to said temperature sensor and in turn connected to said first and second electromagnetic valves of said air-fuel mixture supply means causing means, said switch means being arranged to cause said first and second electromagnetic valves to open said first and second auxiliary air bleeds, respectively, when receiving from said temperature sensor the electric signal representing the temperature over said predetermined level, whereas to cause said first and second electromagnetic valves to close said first and second auxiliary air bleeds, respectively, when receiving from said temperature sensor the electric signal representing the temperature below said predetermined level.

8. An internal combustion engine as claimed in claim 3, in which said combustion chamber defining means defines a plurality of combustion chambers.

9. An internal combustion engine as claimed in claim 8, in which the longitudinal axis of said elongate casing of said reactor is substantially parallel to the longitudinal axis of the cylinder block of the engine, said reactor having a plurality of inlets which are respectively parallelly connected to a plurality of exhaust ports which are respectively communicated with the plurality of combustion chamber, said inlets directly communicating with the first portion of the reaction chamber of said reactor.

10. An internal combustion engine as claimed in claim 9, in which said reactor includes a partition wall dividing said reaction chamber into a first chamber and a second chamber communicating with said first chamber, said first chamber forming part of said first portion of said reaction chamber.

11. An internal combustion engine as claimed in claim 9, in which said elongate casing of said reactor is in the form of cylinder and having first and second closed ends.

12. An internal combustion engine as claimed in claim 11, in which said reactor includes a cylindrical core defining thereinside a bore, coaxially disposed within said cylindrical casing spaced apart from the inner surface of the cylindrical portion of said casing, one end of said cylindrical core being secured to the inner surface of said first closed end of said cylindrical casing and the other end of said cylindrical core being spaced apart from the inner surface to said second closed end of said cylindrical casing to define outlet port means to communicate between the inside and the outside of said cylindrical core, said plurality of inlets opening to the inside of said cylindrical core for introducing the exhaust gases from the combustion chambers into the inside of said cylindrical core, making the inside of the cylindrical core said first portion of the reaction chamber, said outlet being located at the cylindrical portion of said cylindrical casing adjacent to said first closed end of said cylindrical casing.

13. An internal combustion engine as claimed in claim 11, in which said reactor includes a cylindrical core defining thereinside a bore, coaxially disposed within said cylindrical casing spacing apart from the inner surface of the cylindrical portion of said cylindrical casing, both ends of said cylindrical core being secured respectively to the inner surface of said first and second closed ends of said cylindrical casing, said cylindrical core having outlet port means formed through its wall adjacent to said second closed end of said casing to communicate between the inside and outside of said cylindrical core, said plurality of inlets opening to the inner side of said core for introducing the exhaust gases from the combustion chambers into the inner side of said core, making the inside of the cylindrical core said first portion of the reaction chamber, said outlet being located at the cylindrical portion of said casing adjacent to said first closed end of said casing.

* * * * *